US007581288B2

(12) United States Patent
Zhang

(10) Patent No.: US 7,581,288 B2
(45) Date of Patent: Sep. 1, 2009

(54) SUCTION TUBE FOR A VACUUM CLEANER

(76) Inventor: Yuqi Zhang, Suite 306, No. 34 Xibeihuaxiang, Jingle Road, Suzhou, Jiangsu (CN) 215003

( * ) Notice: Subject to any disclaimer, the term of this patent is extended or adjusted under 35 U.S.C. 154(b) by 452 days.

(21) Appl. No.: 10/539,996

(22) PCT Filed: Sep. 27, 2003

(86) PCT No.: PCT/CN03/00825

§ 371 (c)(1),
(2), (4) Date: Jun. 17, 2005

(87) PCT Pub. No.: WO2004/054422

PCT Pub. Date: Jul. 1, 2004

(65) Prior Publication Data

US 2006/0053585 A1 Mar. 16, 2006

(30) Foreign Application Priority Data

Dec. 18, 2002 (CN) ..... 02 2 92939 U
Feb. 27, 2003 (CN) ..... 03 1 06916

(51) Int. Cl.
*A47L 9/02* (2006.01)
*A47L 9/24* (2006.01)
*F16B 7/10* (2006.01)

(52) U.S. Cl. ..... 15/414; 285/7; 403/109.2

(58) Field of Classification Search ..... 15/414; 285/7; 403/109.1–109.8
See application file for complete search history.

(56) References Cited

U.S. PATENT DOCUMENTS 6,454,308 B1 * 9/2002 Kim ..... 285/7
6,634,674 B1 * 10/2003 Xu ..... 285/7

FOREIGN PATENT DOCUMENTS

| | | | |
|---|---|---|---|
| CN | 1203775 | | 1/1999 |
| CN | 1223105 | | 7/1999 |
| CN | 1264568 | | 8/2000 |
| CN | WO 0150939 | A1 * | 7/2001 |
| CN | 2522029 | | 11/2002 |
| CN | 2522029 | Y * | 11/2002 |
| DE | 196 15 814 | | 10/1996 |
| WO | WO 02/38026 | | 5/2002 |

* cited by examiner

*Primary Examiner*—Bryan R Muller
(74) *Attorney, Agent, or Firm*—Kam W. Li; Procopio, Cory, Hargreaves & Savitch LLP

(57) ABSTRACT

The present invention provides a suction tube for a vacuum cleaner, which comprises an outer pipe (8), an inner pipe (1) received in the outer pipe, and a locking device (20) disposed between the inner pipe (1) and the outer pipe (8). A guiding bush (2) is provided at the inner wall of the outer pipe (8). The inner pipe (1) is provided with a row of detent holes (9) which are arranged in the axial direction of the inner pipe (1). An inner liner tube (12) is fixed onto the inner wall of the inner pipe (1). Thus, the manufacturing of the detent recesses becomes easier since the detent holes are made through the inner wall of the inner pipe, and the air leakage of the inner pipe due to the detent holes can be prevented by the inner liner tube (12) provided at the inner pipe (1).

7 Claims, 4 Drawing Sheets

C - C

SUCTION TUBE FOR A VACUUM CLEANER

FIELD OF THE INVENTION

The present invention relates to a vacuum cleaner, and more particularly, to a suction tube for a vacuum cleaner.

BACKGROUND OF THE INVENTION

A conventional suction tube for a vacuum cleaner comprises an outer pipe, an inner pipe inserted into the outer pipe, a guiding bush disposed at the outer pipe, a plurality of detent recesses axially provided at the outer surface of the inner pipe, and a locking device disposed between the inner pipe and the outer pipe. The detent recesses contains a locking pin roller which can be inserted into one of the detent recesses. The locking pin roller has a mantle at its top for keeping the locking device in its locking state. The locking pin roller can move upward out of the recess to make the locking device unlocked, when the mantle is removed. As a result, the inner pipe can be moved axially with respect to the outer pipe. Guiding slopes are provided at the front and rear edges of the detent recesses so as to help the locking pin roller be released from the detent recess easily. However, the locking pin roller is liable to escaping from the detent recess along the guiding slopes under an impact arisen between the inner pipe and the outer pipe. In this case, the locking device will fail to work.

To overcome the above drawbacks, Chinese patent No. 01266578.9 provides a telescopic suction tube for a vacuum cleaner, in which an inner pipe of this telescopic suction tube is provided with a plurality of detent recesses. The sidewalls of the detent recesses are perpendicular to the outer surface of the inner pipe. Although such detent recesses make the locking device thereof be capable of withstanding heavier impact, they are likely to crack at a portion between the sidewall of the recess and the bottom thereof perpendicular to the sidewall arisen by a stress generated from the manufacturing thereof. As a result, air leakage will happen to the inner pipe and the vacuum degree in the inner pipe of the vacuum cleaner will be decreased accordingly, when the vacuum cleaner operates.

SUMMARY OF THE INVENTION

The object of the present invention is to provide a suction tube for a vacuum cleaner having detent recesses that are easy to manufacture. The suction of the invention is capable of withstanding a heavy axial impact.

The suction tube of the present invention comprises an outer pipe; an inner pipe received in said outer pipe; a locking device having an detent pin for latching said inner pipe with respect to said outer pipe; a guiding bush attached to said outer pipe; a first guiding member disposed on said guiding bush for guiding said inner pipe and said outer pipe to move axially with respect to each other; a second guiding member disposed on said inner pipe for guiding said inner pipe and said outer pipe to move axially with respect to each other, said first guiding member and second guiding member are engageable and slidable with each other, characterized in that:

said inner pipe is provided axially with a row of detent holes, each of which penetrates through the wall of the inner pipe, an inner liner layer is fixed onto the inner wall of said inner pipe for isolating vacuum of the inner pipe from the detent holes, said detent pin of said locking device inserts into one of said detent holes when said locking device is in a locking state, while disengages with the detent hole when said locking device is in an unlocking state.

The present invention is advantageous over the prior arts in that the manufacturing of the detent holes becomes easier since these recesses are made penetrating through the inner wall of the inner pipe, and the air leakage on the inner pipe due to such penetrating of the detent recesses can be prevented by the inner liner layer provided on the inner wall of said inner pipe.

BRIEF DESCRIPTION OF THE DRAWINGS

Preferred embodiments of the invention will now be described with reference to the drawings, in which.

DESCRIPTION OF PREFERRED EMBODIMENTS OF THE INVENTION

Figure 1:
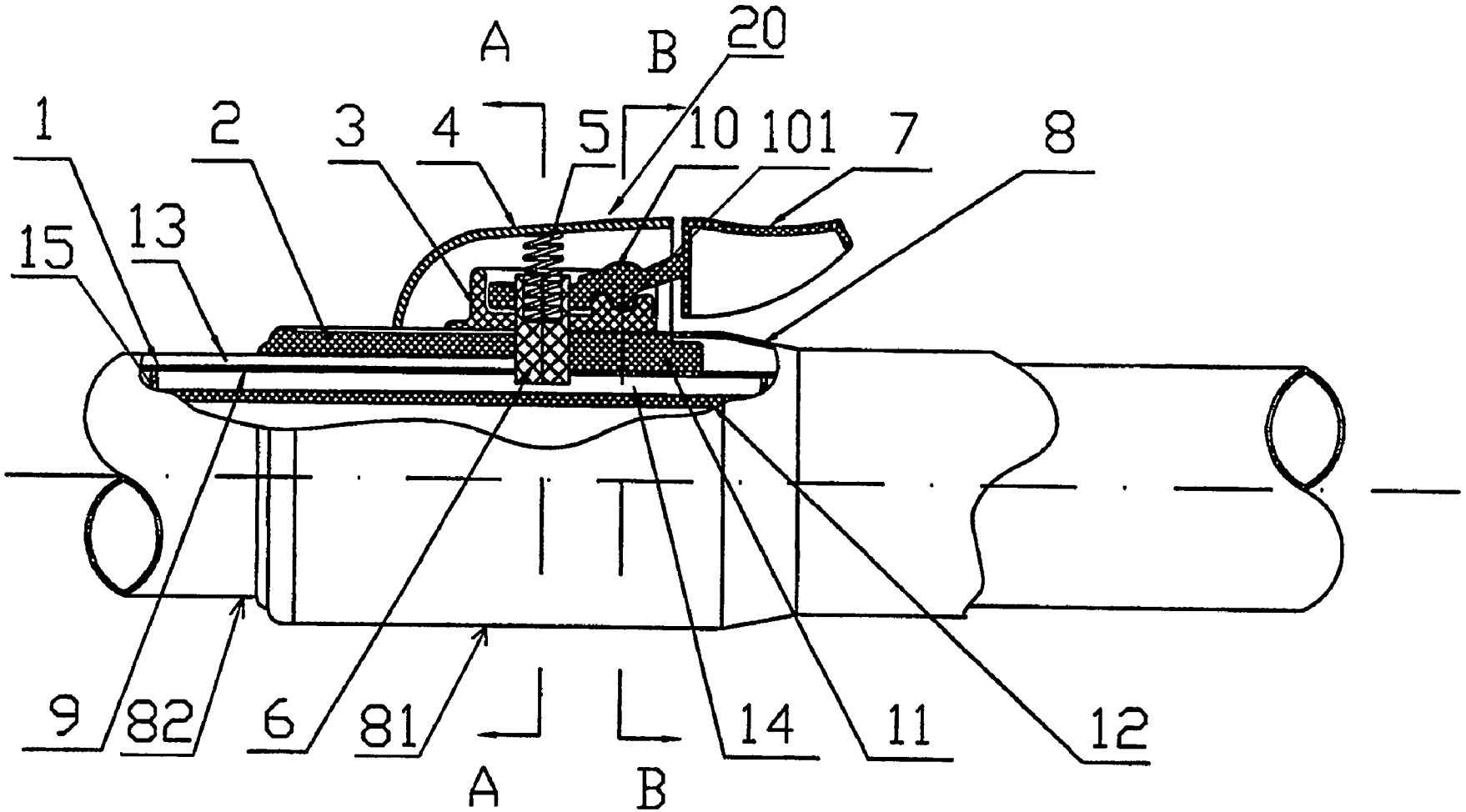
FIG. 1 shows a partial cross-sectional view of an embodiment of the suction tube of the present invention in the locking state.

Referring to FIG. 1 to FIG. 6, a suction tube for a vacuum cleaner of one embodiment of the invention comprises an outer pipe 8 having a larger portion 81 and a smaller portion 82, an inner pipe 1 which is received in the outer pipe 8, and a locking device 20 disposed at the outer pipe 8 for latching the inner pipe 1 with respect to the outer pipe 8. A guiding bush 2 is fixed to the inner wall of the portion 81 of the outer pipe 8 where it has a larger diameter than the smaller portion 82. A first guiding member and a second guiding member are respectively disposed at the guiding bush 2 and the inner pipe 1 for guiding the inner pipe 1 to move axially with respect to the outer pipe 8. The two guiding members are engageable and slidable with each other, so that the inner pipe 1 is axially movable but unrotatable when moving in the outer pipe 8. A row of detent holes 9 are provided axially at the inner pipe 1. Each of the holes 9 penetrates radially through the wall of the inner pipe 1. An inner liner layer, which is an inner liner tube 12 in this embodiment, is fixedly disposed at the inner surface of the wall of the inner pipe 1.

Figure 2:
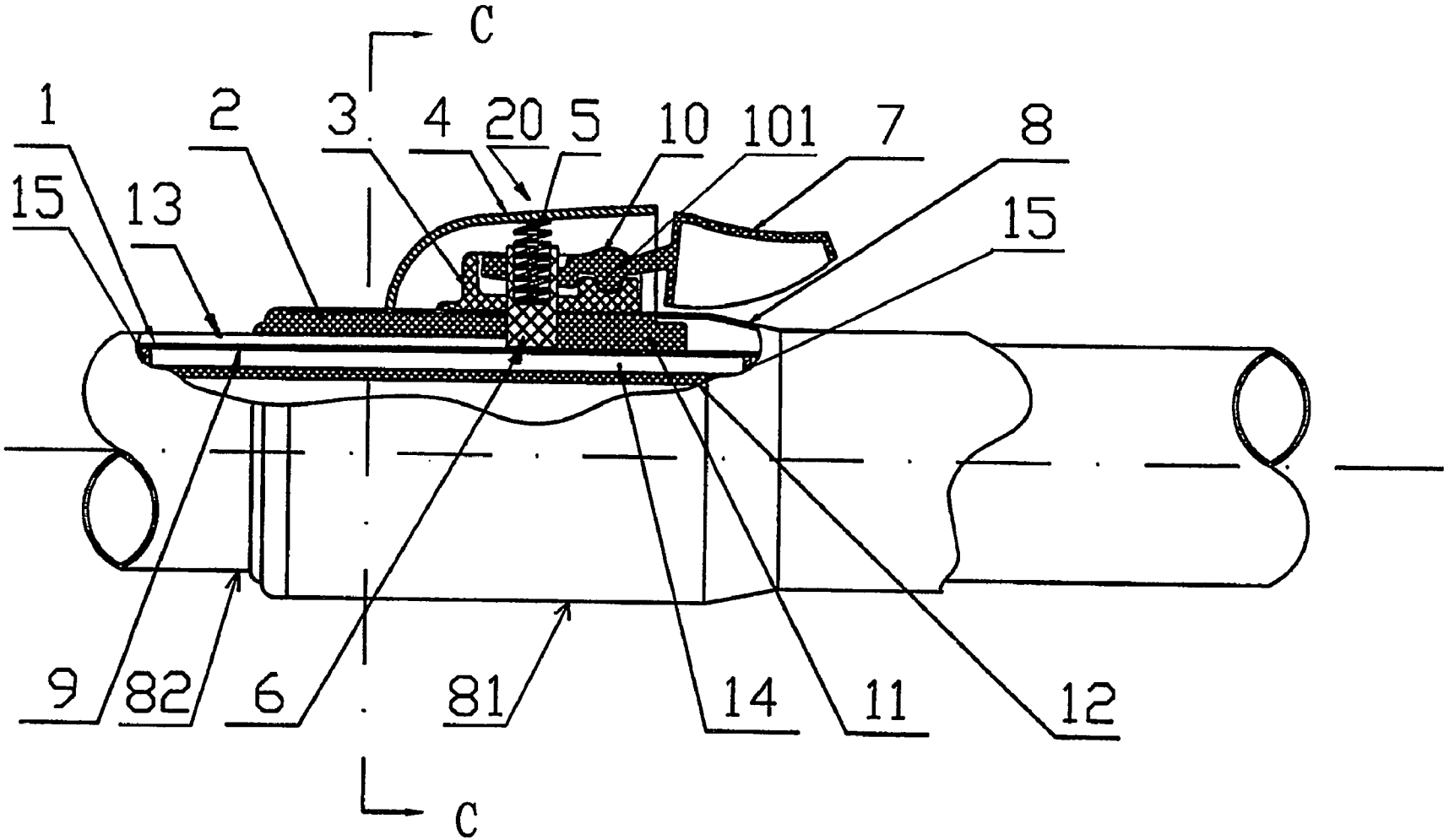
FIG. 2 shows a partial cross-sectional view of an embodiment of the suction tube of the present invention in the unlocking state.
Figure 3:
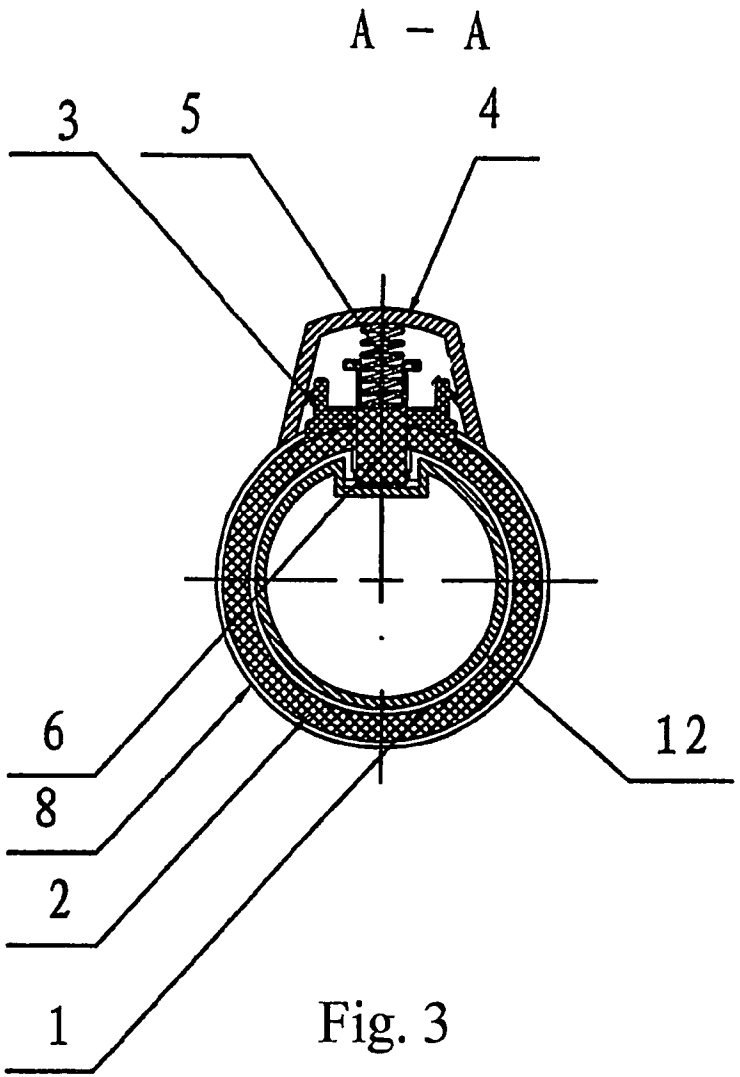
FIG. 3 shows a cross-sectional view taken along line A-A as shown in FIG. 1.

As shown in FIGS. 1 and 2, in this embodiment, the locking device 20 includes a detent pin 6. When the detent pin 6 is inserted into one of the detent holes 9, the locking device is in a locking state (FIG. 1), and when it disengage with the detent holes 9, the locking device is in a unlocking state (FIG. 2).

Also referring to FIG. 1 and FIG. 2, the locking device 20 further comprises a detent pin boss 3 fixed to the outer pipe 8, a spring 5 connected to the detent pin 6, and a detent shifting fork 10 connected to the detent pin 6 with one end and the middle part thereof connected rotatably to the detent pin boss 3. The detent pin 6 is slidable in the radial direction of the outer pipe 8 for inserting into the detent pin boss 3 and the holes 9. The locking device provides a casing 4 connected to the outer pipe 8. Another end of the detent shifting fork 10 extends toward out of a hatch of the casing 4 and forms a button 7. When the operator presses the button 7, the end of the detent shifting fork 10 to which the detent pin 6 is connected overcomes the elastic force of the spring 5 to lift the detent pin 6 by means of a pivot 101, thereby switching the locking device 20 from the locking state into the unlocking state.

Figure 6:
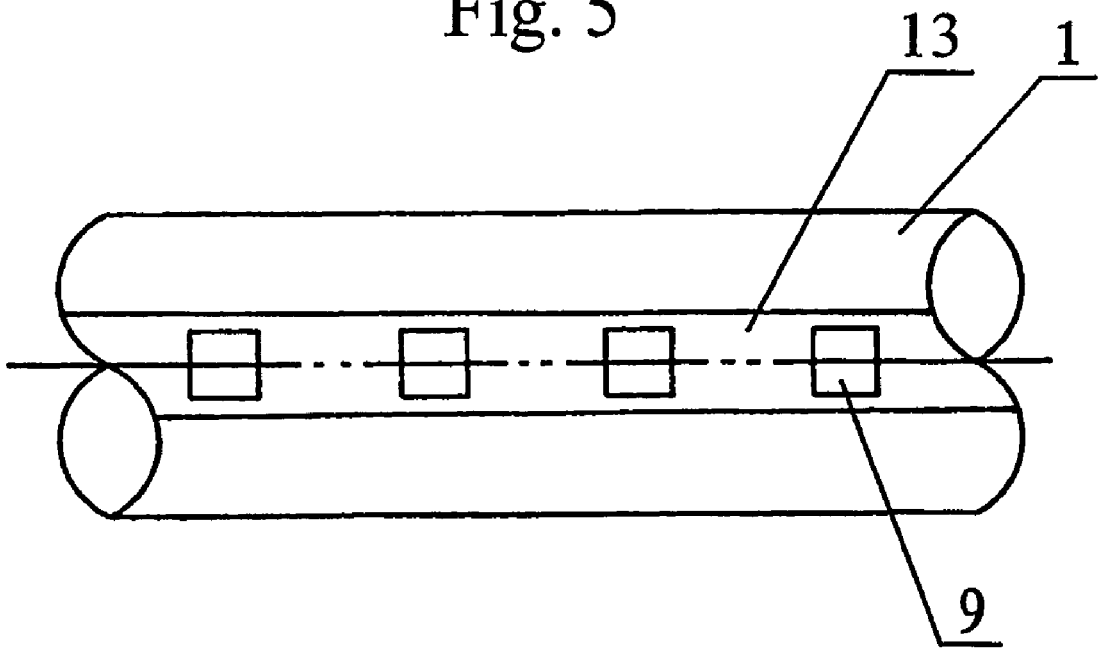
FIG. 6 shows a top view of an inner pipe of the suction tube according to the invention.

The second guiding member is a guiding slot 13 axially disposed at the outer wall of the inner pipe 1, and the first guiding member is a guiding rib 11 which is disposed at the inside wall of the guiding bush 2 and protrudes toward its axial center. The guiding rib 11 is disposed in the guiding slot 13 and is slidable therein. As shown in FIG. 6, a row of the detent holes 9 are provided at the guiding slot 13.

Figure 4:
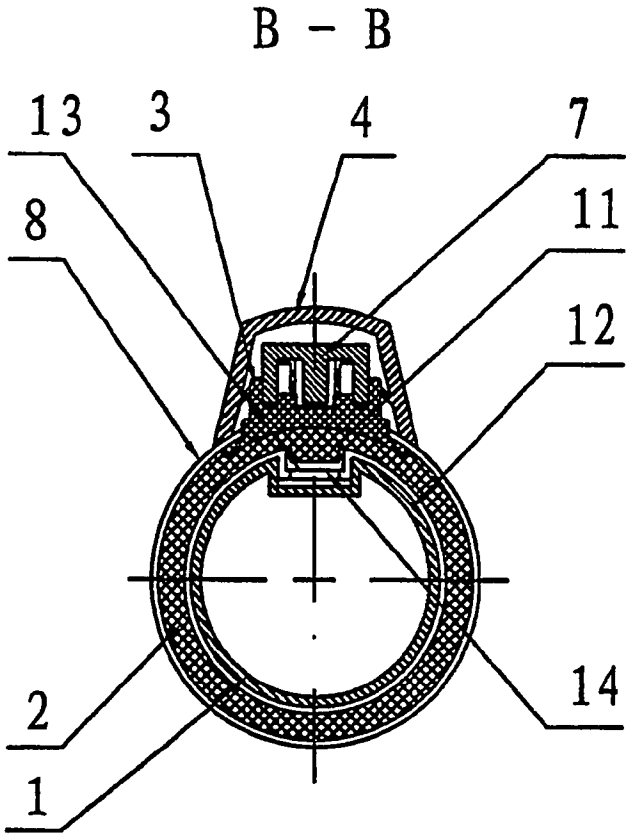
FIG. 4 shows a cross-sectional view taken along line B-B as shown in FIG. 1.
Figure 5:
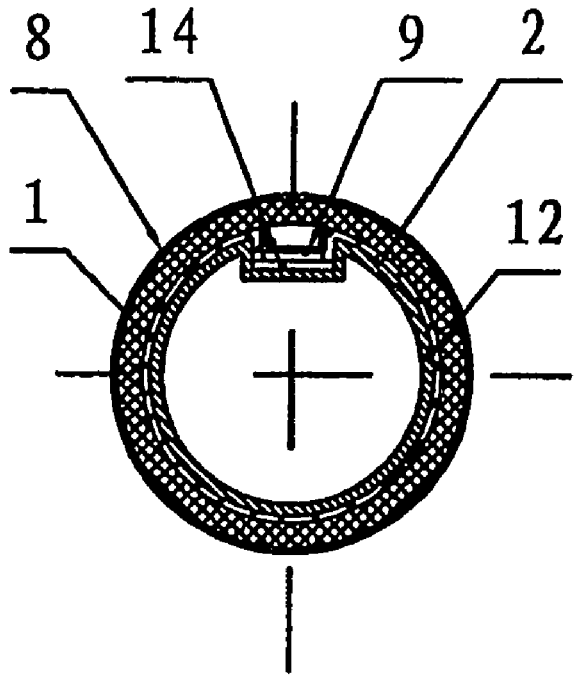
FIG. 5 shows a cross-sectional view taken along line C-C as shown in FIG. 2.

As shown in FIG. 4, the inner liner tube 12 provides at its outside wall a groove 14 extending axially and facing toward the detent holes 9.

There exists a clearance between the outer surface of the inner liner tube 12 and the inner surface of the inner pipe 1. The clearance in the present embodiment is the groove 14. When the locking device is in the locking state, the detent pin 6 penetrates through one of the detent holes 9 and inserts into the clearance. Therefore, it is not liable for the detent pin 6 to escape from the detent hole 9 when the outer pipe 8 and the inner pipe 1 encounter an axial impact, thereby ensuring a reliable locking state between the inner pipe 1 and the outer pipe 8. The inner liner tube 12 is provided with end sealing members at two ends of the groove 14. The end sealing members block at both ends of the groove 14 the clearance between the outer wall of the inner liner tube 12 and the inner wall of the inner pipe 1. Thus, the portions of the inner pipe 1 where air leakage is liable to occur due to the detent holes are sealed by the end sealing members 15 and the inner liner tube 12. When the vacuum cleaner works and the airflow with negative pressure is flowing in the inner liner tube 12, no air will leak through the detent holes 9 into the inner liner tube 12.

The invention claimed is:

1. A suction tube for a vacuum cleaner comprising:

an outer pipe;

an inner pipe received in said outer pipe, the inner pipe having an outer surface and an inner surface and being provided axially with a row of detent holes, each of which penetrates through the wall of the inner pipe from said outer surface to said inner surface;

a locking device having a detent pin for positioning said inner pipe with respect to said outer pipe;

a guiding bush attached to said outer pipe, a first guiding member disposed at the guiding bush;

a second guiding member attached to said inner pipe, being engageable and slidable with said the first guiding member so that said inner pipe and said outer pipe can move axially with respect to each other;

a separate inner liner layer secured at a fixed position to the inner surface of said inner pipe, the inner liner layer isolating vacuum of the inner pipe from the detent holes;

wherein said detent pin of said locking device is inserted into one of said detent holes when said locking device is in a locking state, and disengages with the detent hole when said locking device is in an unlocking state; and said inner liner layer is an inner liner tube having an outer surface and an inner surface and which is provided at its outer surface with a groove extending axially along said inner liner tube and facing said detent holes.

2. A suction tube for a vacuum cleaner as claimed in claim 1, wherein said locking device further comprises a detent pin boss fixed to said guiding bush, a spring connected to the detent pin, and a detent shifting fork whose one end is connected to the detent pin and the middle part thereof is connected rotatably to the detent pin boss.

3. A suction tube for a vacuum cleaner as claimed in claim 2, wherein said locking device includes a casing having a hatch at its side, and the other end of said detent shifting fork extends toward out of the hatch of the casing and forms a button.

4. A suction tube for a vacuum cleaner as claimed in claim 1, wherein said second guiding member is a guiding slot axially disposed at the outside wall surface of said inner pipe, and said first guiding member is a guiding rib axially disposed at the inside wall of said guiding bush and slidably moved within said guiding recess.

5. A suction tube for a vacuum cleaner as claimed in claim 4, wherein said detent holes are disposed at said guiding slot.

6. A suction tube for a vacuum cleaner as claimed in claim 1, wherein a clearance is provided between the outer surface of the inner liner tube and the inner surface of the inner pipe, and when the locking device is in the locking state, the detent pin penetrates through one of the detent holes and inserts into the clearance, the detent pin being spaced from the outer surface of the inner liner tube in said locking state.

7. A suction tube for a vacuum cleaner as claimed in claim 1, wherein said inner liner tube is provided with end sealing members at two ends of said groove which extend between the outer surface of said inner liner tube and the inner surface of said inner tube to block the clearance between the outer surface of said inner liner tube and the inner surface of said inner pipe.

* * * * *